US009718087B1

(12) United States Patent
Woods et al.

(10) Patent No.: US 9,718,087 B1
(45) Date of Patent: Aug. 1, 2017

(54) TREATED APPLICATOR TO INCREASE PERFORMANCE

(71) Applicant: The Sherwin-Williams Company, Cleveland, OH (US)

(72) Inventors: Jason T. Woods, Olmsted Township, OH (US); Jospeh N. Biber, Macedonia, OH (US); Charles T. Buckel, Jr., Valley City, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 13/835,866

(22) Filed: Mar. 15, 2013

(51) Int. Cl.

| | |
|---|---|
| ***B05C 17/00*** | (2006.01) |
| ***A46D 1/00*** | (2006.01) |
| ***D06M 13/513*** | (2006.01) |
| ***B05C 1/08*** | (2006.01) |
| ***D03D 1/00*** | (2006.01) |
| ***B05C 1/06*** | (2006.01) |

(52) U.S. Cl.
CPC ..... *B05C 17/00* (2013.01); *A46D 1/0207* (2013.01); *D06M 13/513* (2013.01); *A46B 2200/202* (2013.01); *B05C 1/06* (2013.01); *B05C 1/08* (2013.01); *D03D 1/00* (2013.01)

(58) Field of Classification Search
CPC ..... C08L 83/04–83/08; C09D 183/04–183/08; C08G 77/04–77/398; D06N 2203/066; D06M 11/01; D06M 11/05
USPC ..... 15/230–230.19, 257.06; 492/13, 17, 19, 492/48, 28–37; 134/138, 149, 900; 442/59, 81, 87, 99, 152, 153, 157, 442/167–169, 181, 199, 249, 304, 311; 428/85, 91, 96, 364–365, 375, 391–396; 427/372.2, 384, 385.5, 387, 389.9, 394
See application file for complete search history.

(56) References Cited

U.S. PATENT DOCUMENTS

| | | | | |
|---|---|---|---|---|
| 3,755,840 | A * | 9/1973 | Barger | B44D 3/006 134/138 |
| 4,466,151 | A * | 8/1984 | Barch | B05C 17/0207 15/227 |
| 4,548,859 | A | 10/1985 | Kline et al. | |
| 5,542,144 | A | 8/1996 | Forsline | |
| 5,974,293 | A | 10/1999 | Fromm | |
| 6,032,322 | A | 3/2000 | Forsline | |
| 6,308,371 | B1 | 10/2001 | Forsline | |
| 6,390,476 | B1 | 5/2002 | Tong et al. | |
| 6,761,673 | B2 | 7/2004 | Shudo | |
| 6,962,640 | B2 | 11/2005 | Mäker et al. | |
| 7,258,925 | B2 | 8/2007 | Franchina et al. | |
| 7,329,707 | B2 * | 2/2008 | Sandner et al. | 524/838 |
| 8,013,097 | B2 * | 9/2011 | Kennan et al. | 528/25 |
| 2005/0014432 | A1 * | 1/2005 | Jain et al. | 442/76 |
| 2010/0125963 | A1 * | 5/2010 | Kneidel | 15/207.2 |
| 2010/0178519 | A1 * | 7/2010 | Heiberger et al. | 428/447 |
| 2010/0267601 | A1 * | 10/2010 | Panandiker | C11D 3/2072 510/276 |

OTHER PUBLICATIONS

Wooster, Knitted vs. Woven, archived Nov. 10, 2011, http://www.woosterbrush.com/lowes/rl_verses.html.*
The Painted Surface, How to Choose a Paint Brush, archived Feb. 6, 2011, http://thepaintedsurface.com/how-to-choose-paint-brush-p2.php.*
Wacker Silicones, Advalon FF 230, archived Nov. 23, 2008, http://www.wacker.com/cms/media/publications/downloads/6451_EN.pdf.*
STN Search Notes Sep. 24, 2014.*
Celanese Acetate LLC, Complete Textile Glossary, 2001.*

* cited by examiner

*Primary Examiner* — Frank Vineis
(74) *Attorney, Agent, or Firm* — Daniel A. Sherwin; James C. Scott; Peter T. Nguyen

(57) ABSTRACT

A paint applicator having improved paint-carrying capacity, release, and coverage. The applicator includes a paint-carrying surface that is treated with a silicone emulsion, a silicone emulsion comprised of a nonionic macro-emulsion of a functional polysiloxane, or a mixture thereof. Also provided is a method for treating such paint applicators in which a silicone emulsion is applied to the paint-carrying surface, and subsequently dried and cured.

32 Claims, No Drawings

TREATED APPLICATOR TO INCREASE PERFORMANCE

FIELD OF THE INVENTION

This invention relates to the field of paint applicators having improved properties and to a method of treating the paint-carrying surfaces of the applicators with various silicone emulsions.

BACKGROUND OF THE INVENTION

Paint rollers, paint brushes and other paint tools are widely used as applicators as a means of applying paint to surfaces. However, cleaning the applicators after their use is an unpleasant task because of the difficulty in removing all the paint from in between the paint-carrying fibers. Failure to remove all the paint will lead to fibers that are too stiff to provide a smooth painted surface, and with individual fibers that are too fouled and poorly separated to provide a suitable paint-carrying capacity. On the other hand, a very thorough cleaning typically requires many washings, with additional cleaning of the hands and containers used, generating large amounts of contaminated wash solvents for disposal.

There is a need for paint applicators, such as paint roller covers and brushes that have an increased paint-carrying capacity (i.e., paint pick-up), release, and coverage during use. The present invention provides such paint applicators.

SUMMARY OF THE INVENTION

The present invention relates to a paint applicator comprising a paint-carrying surface that is treated with a silicone emulsion, a silicone emulsion comprised of a nonionic macro-emulsion of a functional polysiloxane, or a mixture thereof. The present invention further comprises a method of treating a paint applicator comprising application to its paint-carrying surface, or the precursor thereof, with a silicone emulsion, a silicone emulsion comprised of a nonionic macro-emulsion of a functional polysiloxane, or a mixture thereof.

DETAILED DESCRIPTION OF THE INVENTION

Trademarks are denoted herein by capitalization.

The present invention provides a paint applicator, having improved paint-carrying capacity, release, coverage, and processes for its preparation. The paint applicator of the present invention comprises various embodiments such as paint rollers, paint brushes, paint pads, patterned rollers, patterned pads, paint sponges, paint cloths, and other physical forms wherein the paint-carrying surface has been treated (coated, saturated, or otherwise) with a silicone emulsion, a silicone emulsion comprised of a nonionic macro-emulsion of a functional polysiloxane, or a mixture thereof.

This invention further comprises methods for treating a paint applicator, or the fabrics, fibers (woven, knitted, or otherwise), or filaments that make up the paint-carrying surface with various silicone emulsions, silicone emulsion comprised of a nonionic macro-emulsion of a functional polysiloxane, or mixtures thereof. In certain embodiments, the method comprises the steps of applying a silicone emulsion to a paint-carrying surface of the applicator, drying the treated paint-carrying surface and curing the treated paint-carrying surface. It should be appreciated that applying the silicone emulsion may be performed by means of immersing or submerging the paint-carrying surface in a bath containing a silicone emulsion, or by means of spray applying the paint-carrying surface with a silicone emulsion. Drying and curing the treated paint-carrying surface may be accomplished by means of an oven or spin drying.

Suitable fabrics, fibers, filaments, or otherwise may be comprised of natural (e.g., mohair, wool) or synthetic fibers selected from acetate fibers; cellulose ester fibers; acrylic fibers; modacrylic fibers; acrylic/modacrylic fibers; polyamide fibers; polyolefin fibers; polyvinyl alcohol fibers; rayon fibers; polyethylene foam; polypropylene; keratin fibers; cellulose fibers; silk fibers and combinations thereof. Useful acrylic/modacrylic blends of roller cover fibers for use in this invention include DRALON (dry- and wet-spun acrylic fibers) and KANECARON (modified acrylic (modacrylic) fibers made from copolymers of acrylonitrile and other materials such as vinylidene chloride), which are available commercially from Dralon GmbH and Waxman International Ltd. respectively. Non-woven fibers may be comprised of mono-component fibers, such as a polyolefin or polyester, or bi-component fibers, such as a sheath/core fiber or side by side fiber of polyethylene/polypropylene or polyethylene/polyester, or bi-constituent fibers comprised by a blend of two or more thermoplastic polymers.

Other fabrics (e.g., plush pile), fibers, filaments, or otherwise that may be used in this invention include, but are not limited to, nylon (such as nylon 4,6; nylon 6,6; and nylon 6), cotton, polyester, cotton/polyester, nylon/polyester, cotton/nylon, LYCRA (segmented polyurethane), aramid, and the like.

One embodiment of the paint applicator of the present invention comprises a paint roller. A paint roller consists of a removable roller cover made of a napped fabric which is placed on a rolling mechanism with a handle. Typically, the roller cover is made by a manufacturing process such as the following: 1) one or more types of staple fibers are mixed, combed, carded and knitted; 2) the knitted fabric is then fed to a backcoating machine where a latex backing is applied and cured; 3) the fabric is then cut and wound around a plastic roller, where it is held in place by glue or by melting the backing onto the fabric; 4) it is then combed and sheared and cut to the proper length for a roller. The nap length of the fabric can range from ¼" inch (0.635 cm) to about 1½" inches (3.81 cm). The fabric is typically made of the following: 1) nylon, polyester fibers, or mixtures thereof; 2) acrylic, modacrylic, or mixtures thereof; and 3) may also include other synthetic or natural fibers. Roller covers as disclosed herein may also be comprised of other materials, such as foam, foam sponge, flocked foam, flocked foam sponge, or other cloth material. The roller surface can be flat or patterned. The roller covers useful for this invention can be made by the above manufacturing process, or by any other manufacturing process.

Another embodiment of the paint applicator of this invention comprises a paintbrush. A paintbrush is made by mixing filaments (e.g., bristles) of the same or different lengths, organizing them into filament bundles with parallel filaments, putting the filament bundles into a metal ferrule along with an adhesive such as epoxy resin or glue, curing or drying the adhesive, and attaching the paintbrush handle to the ferrule. The length of the filaments and the number of filaments in a brush will vary with the intended application. The filaments are typically nylon, polyester fibers, or mixtures thereof, acrylic, modacrylic fibers, or mixtures thereof, but may instead be other synthetic or natural fibers obtained from various sources (e.g., camel, horse, rabbit) for certain applications. The paint brushes of this invention can be made by the above manufacturing process, or by any other manufacturing process.

This invention further comprises a method for preparing a paint applicator, such as a roller cover or paint brush, with improved paint-carrying capacity, release, coverage, wherein the surface of the paint-carrying fibers are treated with a silicone emulsion, a silicone emulsion comprised of a nonionic macro-emulsion of a functional polysiloxane, or a mixture thereof, at any stage prior to and during the applicator-manufacturing process.

Other embodiments of the present invention include paint pads, mats, clothes, sponges, combs, papers, feathers, styluses, knives, and other applicator tools treated with a silicone emulsion, a silicone emulsion comprised of a nonionic macro-emulsion of a functional polysiloxane, or a mixture thereof.

Silicone emulsions for use in this invention may be in the form of aqueous emulsions. The polymers may be applied to the paint-carrying fabric, filaments, or fibers either alone or in a mixture with other treatment agents or finishes. The silicone emulsions can be applied to the paint-carrying fabric, filaments, or fibers by spraying, foaming, kiss coating, dipping, padding, or other well-known methods, commonly used to impart oil-, soil- and water-repellency to textiles and carpets.

In certain embodiments, roller covers are treated with silicone emulsions comprising a nonionic macro-emulsion of a functional polysiloxane. In other embodiments, roller covers are treated with substances in the following percentages by weight: 1) from about 1.0% to about 5.0% of 1,2-Ethanediamine, N-[3-(dimethoxy methylsilyl) propyl]-; and 2) from about 1.0% to about 5.0% of branched tridecanolethoxylate. Additional embodiments may comprise silicone emulsions having a solids content of about 50%, a pH of about 7 to about 8, a viscosity of about 100 to about 500 mPa·s, a vapor pressure of about 23 hPa at about 20° C. (about 68° F.), and a density of about 1 g/cm$^3$ at about 20° C. (about 68° F.).

In other embodiments, roller covers are treated with silicone emulsions comprising substances in the following percentages by weight: 1) from about 1.0% to about 5.0% of 1,2-Ethanediamine, N-[3-(dimethoxy methylsilyl) propyl]-; 2) from about 1.0% to about 5.0% of branched tridecanolethoxylate; and 3) from about 0.1% to about 1.0% of acetic acid. Embodiments of the invention may also comprise silicone emulsions having a solids content of about 70%, a pH of about 7, a viscosity of about 100 to about 500 mPa·s, a vapor pressure of about 23 hPa at about 20° C. (about 68° F.), and a density of about 1 g/cm$^3$ at about 20° C. (about 68° F.).

Suitable silicone emulsions for use in this invention include ADVALON® FF 230 VP and WACKER® CT 209 E silicone emulsions, which are available commercially from Wacker Chemie AG. ADVALON® FF 230 VP silicon emulsion is known to skilled artisans. ADVALON® FF 230 VP silicone emulsion is a nonionic macro-emulsion of a functional polysiloxane. ADVALON® FF 230 VP silicone emulsion is a one component finish that imparts softness and resiliency to fiber fill and shape-stabilizing characteristics to textile fabrics. The macro-emulsion is a polydimethylsiloxane with functional groups (emulsion in water) containing tridecanolethoxylate, branched (3 to 5 weight %); 3-2(2-aminoethylamino)propylmethyldimethoxysilane (3 to 5 weight %); tridecanol ethoxylate, branched (less than 3 weight %); acetic acid (less than 2 weight %); and ocamethyl cyclotetrasiloxane (less than or equal to 1 weight %). WACKER® CT 209 E silicon emulsion is known to skilled artisans. WACKER® CT 209 E silicone emulsion is a nonionic macro-emulsion of a functional polysiloxane. WACKER® CT 209 E silicone emulsion is a one component finish that imparts softness and resiliency to fiber fill and shape-stabilising characteristics to textile fabrics. The macro-emulsion is a polydimethylsiloxane with functional groups (emulsion in water) containing 1,2-Ethanediamine, N-[3-(dimethoxy methylsilyl) propyl]- (1 to 5 weight %) and tridecanolethoxylate, branched (1 to 5 weight %).

In certain embodiments, roller covers are dipped into pad baths containing various concentration levels of silicone polymer emulsions, in which the emulsions may be present in the amounts of about 7%, about 10%, about 5%, or about 20% based on the total weight, with water added to total 100%.

In some embodiments (e.g., roller cover), a useful method for treating the applicator is achieved by applying the polymer emulsion to the precursor of the paint-carrying surface (e.g., fibers, filaments, or fabric) prior to its attachment to the applicator itself. The polymer or copolymer silicone emulsion may be applied to the knitted fabric on a back-coating machine, against the force of gravity, by means of a press roll. After excess liquid has been removed, for example by squeeze rolls, the treated roller cover fabric is dried and then cured by heating, for example, from about 40° C. (about 120° F.) to about 60° C. (about 140° F.), for about 30 minutes. Such curing enhances coating durability.

Another method of applying the polymer emulsion to brush filaments is by applying the polymer emulsion to the filaments via a spray mechanism just prior and during the mixing of the filaments. The filaments are well coated with the emulsion and then mixed thoroughly as they would be normally during the mixing process during brush manufacture. The filaments constitute the precursor to the paint-carrying fibers of the paintbrush prior to assembly of the paintbrush.

In additional embodiments, the paint-carrying surface may be treated prior to, during, of after attachment to an applicator. For example, fabric, fibers, filaments, or other materials may be treated prior to being applied, helically wound, and/or secured onto the core of a paint roller cover (whether or not heat bonding is employed). Fibers and the like may also be treated during various stages of being blown together in an air chamber to achieve blending. In other embodiments, fibers may be treated prior to, during, or after combing, shearing, and/or vacuuming processes.

The type of paint use for which this invention may be used is water-based latex paints. Typically, these contain resins such as acrylics, epoxies, vinyls, and others. Such paints are readily available in the marketplace under a number of major brands.

Tables 1-6 illustrate specific embodiments and practices of advantage to a more complete understanding of the invention. Unless otherwise stated, "parts" means parts-by-weight and "percent" means "percent-by-weight". The following illustrative examples include PURDY White Dover roller covers (i.e., a acrylic/modacrylic blend of fabric) and PURDY Golden Eagle roller covers (i.e., a polyester/nylon blend of fabric) treated at various percentages of silicone emulsions. Two different silicone emulsions were used:

WACKER® CT 209E silicone emulsion

ADVALON® FF 230VP silicone emulsion

The subject roller covers were treated with different levels/concentrations of solution:

Purdy ½" (roller cover fiber length) White Dove (woven roller covers)-Untreated Control Purdy ½" White Dove-Treated with 7%, 10%, 15% and 20% WACKER® CT209E silicone emulsion Purdy ½" White Dove-Treated with 7%, 10%, 15% and 20% ADVALON® FF230 silicone emulsion Purdy ½" Golden Eagle (woven roller covers)-Untreated Control Purdy ½" Golden Eagle-Treated with 7%, 10%, 15% and 20% WACKER® CT209E silicone emulsion Purdy ½" Golden Eagle-Treated with 7%, 10%, 15% and 20% ADVALON® FF230 silicone emulsion Each roller cover was weighed to obtain a dry cover weight prior to treatment. The covers were then submerged into pad baths containing various concentration levels of ADVALON® FF230 VP or WACKER® CT209E silicone polymer emulsions (each emulsion is measured by percent active of Silicone by weight). The emulsions were present in the amounts of about 7%, about 10%, about 15%, or about 20% based on the total weight, with water added to total 100%. Preparation of the varying percentage solution baths of emulsions (i.e., 7%, 10%, 15% and 20%) involved calculating the solids by weight of the treatment based on the percent active silicone, adding water, and manually mixing the solution for about 30 to about 60 seconds. Roller covers were immersed in varying concentrations (weight percent solutions) of silicone emulsions for about 10 seconds to about 30 seconds. The roller covers were subsequently spun dry using a manual roller spinner for about 30 seconds to about one to two minutes. An automatic spinner could have also been employed. The weight wet with silicone solution was recorded. After treatment, all covers were placed in an oven at about 120° F. for about 30 minutes for purposes of drying and curing, and weighed again. In certain embodiments of the invention, the covers may be air dried overnight to achieve sufficient levels of dryness and cure.

The treated roller covers were subsequently tested for paint pick-up and release. First, the paint roller cover was "broken in" to ensure that all of the air worked out of the cover before any pickup or release weights were measured. The roller was installed onto the frame and then weighed. This weight was recorded and used to calculate the maximum paint pick up and release for the roller. Paints used in this testing were PROMAR 200 (i.e., a vinyl acrylic paint) and EMERALD Interior Semi-Gloss (i.e., a styrene acrylic paint). The paint tray was filled with a latex paint so that the level was not any higher than the pile height of the fabric. For example, if the roller cover was ½ inch (1.3 cm) pile height, the paint depth was not more than ½ inch (1.3 cm) in the tray. The roller was then rolled into the paint so that the entire circumference was covered. The roller was then rolled out vertically onto panels (measuring eight feet in length and four feet in width) comprising a smooth primed dry wall surface. A rectangle of a specific area was painted. The same numbers of strokes were taken with each roller tested to ensure the same opportunity for paint removal. After the painting of the rectangle was complete, the assembly was weighed again and the difference between this number and the fully loaded number was the discharge capacity of the roller cover in the given area.

The following table headings for paint roller cover data were employed:

"% Inc. in Pick up #1" is the initial improvement in the paint adhering onto the treated roller cover compared to the untreated roller cover, and is equal to "grams paint adhered (treated)" minus "grams paint adhered (untreated)" divided by "grams paint adhered (untreated)".

"% Inc. in Pick up #2" is the subsequent improvement in the paint adhering onto the treated roller cover compared to the untreated roller cover, and is equal to "grams paint adhered (treated)" minus "grams paint adhered (untreated)" divided by "grams paint adhered (untreated)".

"% Inc. in Release #1" is the initial improvement in the paint released onto the panel from the treated roller cover compared to the untreated roller cover, and is equal to "grams paint unloaded(treated)" minus "grams paint unloaded (untreated)" divided by "grams paint unloaded (untreated)".

"% Inc. in Release #2" is the subsequent improvement in the paint released onto the panel from the treated roller cover compared to the untreated roller cover, and is equal to "grams paint unloaded(treated)" minus "grams paint unloaded (untreated)" divided by "grams paint unloaded (untreated)".

"Square feet painted" is the size of the area that was painted for each test. The area is painted as described above.

"% inc." is the improvement in the paint released onto the wall from the treated roller cover compared to the untreated roller cover, and is equal to "grams paint unloaded(treated)" minus "grams paint unloaded (untreated)" divided by "grams paint unloaded (untreated)".

"Coverage" is the width (in inches) of 8' lengths of dry wall coated by a roller cover.

TABLE 1

| Purdy ½" White Dove | | | Type of Paint: ProMar 200 | |
|---|---|---|---|---|
| | % Inc. in Pick up #1 | % Inc. in Pick up #2 | % Inc. in Release #1 | % Inc. in Release #2 |
| 7% CT 209E | 57.15 | 34.82 | 8.96 | 12.45 |
| 10% CT209E | 61.98 | 38.30 | 8.96 | 14.94 |
| 15% CT209E | 68.24 | 45.58 | −3.78 | 25.73 |
| 20% CF209E | 26.69 | 30.69 | −7.08 | 4.57 |
| 7% FF 230 | 41.21 | 28.95 | 14.62 | 8.71 |
| 10% FF230 | 32.00 | 22.91 | 3.30 | 3.73 |
| 15% FF230 | 29.75 | 20.43 | 2.83 | 9.96 |
| 20% FF230 | 25.50 | 26.88 | −42.93 | −0.82 |

TABLE 2

| Purdy ½" Golden Eagle | | | Type of Paint: ProMar 200 | |
|---|---|---|---|---|
| | % Inc. in Pick up #1 | % Inc. in Pick up #2 | % Inc. in Release #1 | % Inc. in Release #2 |
| 7% CT 209E | 9.29 | 2.86 | | |
| 15% FF230 | 5.65 | 2.45 | | |
| 20% FF230 | 0.46 | 0.52 | | |

TABLE 3

| Purdy ½" White Dove | | | Type of Paint: |
|---|---|---|---|
| | % Inc. in Pick up #1 | % Inc. in Pick up #2 | Emerald Interior |
| 7% CT 209E | 10.40 | 5.38 | |
| 10% CT209E | 3.30 | 2.93 | |
| 15% CT209E | 4.57 | 2.79 | |
| 20% CT209E | 3.69 | 5.04 | |

TABLE 4

| Purdy ½" Golden Eagle | | | Type of Paint: Emerald Interior | |
|---|---|---|---|---|
| | % Inc. in Pick up #1 | % Inc. in Pick up #2 | % Inc. in Release #1 | % Inc. in Release #2 |
| 7% CT 209E | −2.88 | 0.11 | −0.59 | 6.71 |
| 10% CT209E | −9.68 | 0.71 | −9.65 | 2.05 |

The resulting data illustrated in Tables 1-4 exemplify improvement of paint pick-up and release in the disclosed invention.

TABLE 5

| ½" White Dove - Woven Dralon/Kanecaron - Acrylic/Modacrylic blend | | | | |
|---|---|---|---|---|
| | | Coverage | sq. ft. | % inc. |
| Control | | 41" | 28 | |
| FF230 | 7% | 47" | 31.2 | 14.6 |
| CT209 | 7% | 46" | 31 | 12.2 |
| FF230 | 10% | 57" | 39.2 | 39 |
| CT209 | 10% | 56" | 36.4 | 36.6 |
| FF230 | 15% | 66" | 44.8 | 61 |
| CT209 | 15% | 65" | 44 | 58.5 |
| FF230 | 20% | 69" | 47.2 | 68.3 |
| CT209 | 20% | 69" | 47.2 | 68.3 |

TABLE 6

| ½" Golden Eagle - Knitted Polyester/Nylon Blend | | | | |
|---|---|---|---|---|
| | | Coverage | sq. ft. | % inc. |
| Control | | 67" | 45.6 | |
| FF230 | 7% | 73" | 48.8 | 8.9 |
| CT209 | 7% | 69" | 47.2 | 2.9 |
| FF230 | 10% | 69" | 47.2 | 2.9 |
| CT209 | 10% | 73" | 48.8 | 8.9 |
| FF230 | 15% | 73" | 48.8 | 8.9 |
| CT209 | 15% | 77" | 52 | 14.9 |
| FF230 | 20% | 72" | 48 | 7.5 |
| CT209 | 20% | 67" | 45.6 | 0 |

The application testing of the illustrative examples on dry wall, as depicted in Tables 5 and 6, demonstrate increased paint coverage for both treated polyester/nylon blends and treated acrylic/modacrylic blends of fabric. Treated PURDY White Dove roller cover fibers increased from about 14% to about 68% in coverage compared to the control; whereas, treated PURDY Golden Eagle roller cover fibers increased from about 3% to about 14% compared to the control.

While this invention has been described by a specific number of embodiments, other variations and modifications may be made without departing from the spirit and scope of the invention as set forth in the appended claims.

We claim:

1. A paint applicator comprising a substrate surface comprising fabric, fibers or filaments, wherein the fabric, fibers or filaments have been treated with a silicone emulsion comprising at least one nonionic macro-emulsion of a functional polysiloxane, wherein the substrate surface has improved paint-carrying capacity, release, and coverage when compared to the identical fabric, fibers, or filaments without such silicone emulsion, wherein the paint applicator is a paint brush, a paint roller, or a cylindrical paint roller cover.

2. The paint applicator of claim 1 wherein the substrate surface comprises a fabric.

3. The paint applicator of claim 2 wherein the fabric comprises cotton, wool, silk, cellulose, or a combination thereof.

4. The paint applicator of claim 3 further comprising a filament.

5. The paint applicator of claim 1 wherein the substrate surfaces comprises a fiber.

6. The paint applicator of claim 5, wherein the fiber comprises cotton, wool, silk, cellulose, or a combination thereof.

7. The paint applicator of claim 5 wherein the fiber is a natural fiber.

8. The paint applicator of claim 1 wherein the silicone emulsion comprises:

(a) from about 1.0% to about 5.0% of 1,2-Ethanediamine, N-[3-(dimethoxy methylsilyl) propyl]-;

(b) from about 1.0% to about 5.0% of branched tridecanolethoxylate.

9. The paint applicator of claim 8, wherein the silicone emulsion has a solids content of about 50%, a pH of about 7 to about 8, a viscosity of about 100 to about 500 mPa s, a vapor pressure of about 23 hPa at about 20° C. (about 68° F.), and a density of about 1 g/cm$^3$ at about 20° C. (about 68° F.).

10. The paint applicator of claim 8, wherein the silicone emulsion has a solids content of about 70%, a pH of about 7, a viscosity of about 100 to about 500 mPa as, a vapor pressure of about 23 hPa at about 20° C. (about 68° F.), and a density of about 1 g/cm$^3$ at about 20° C. (about 68° F.).

11. The paint applicator of claim 1 wherein the silicone emulsion comprises by weight:

(a) from about 1.0% to about 5.0% of 1,2-Ethanediamine, N-[3-(dimethoxy methylsilyl) propyl]-;

(b) from about 1.0% to about 5.0% of branched tridecanolethoxylate; and (c) from about 0.1% to about 1.0% of acetic acid.

12. A paint applicator comprising a substrate surface comprising fabric, fibers or filaments, wherein the fabric, fibers or filaments have been treated with a silicone emulsion comprising at least one nonionic macro-emulsion of a functional polysiloxane, which has dried and cured thereon, wherein the substrate surface is operable to pick up and release paint to provide a predetermined paint coverage, wherein the substrate surface has improved paint-carrying capacity, release, and coverage when compared to the identical fabric, fibers, or filaments without such silicone emulsion, wherein the paint applicator is a paint brush, a paint roller, or a cylindrical paint roller cover.

13. The paint applicator of claim 12 wherein the silicone emulsion comprises substances in the following percentages by weight:

(a) from about 1.0% to about 5.0% of 1,2-Ethanediamine, N-[3-(dimethoxy methylsilyl)propyl]-; and (b) from about 1.0% to about 5.0% of branched tridecanolethozylate.

14. The paint applicator of claim 13 wherein the silicone emulsion has a solids content of about 50%, a pH of about 7 to about 8, a viscosity of about 100 to about 500 mPa s, a vapor pressure of about 23 hPa at about 20° C. (about 68° F.), and a density of about 1 g/cm$^3$ at about 20° C. (about 68° F.).

15. The paint applicator of claim 12 wherein the silicone emulsion comprises substances in the following percentages by weight:

(a) from about 1.0% to about 5.0% of 1,2-Ethanediamine, N-[3-(dimethoxy methylsilyl) propyl]-;

(b) from about 1.0% to about 5.0% of branched tridecanolethoxylate; and (c) from about 0.1% to about 1.0% of acetic acid.

16. The paint applicator of claim 15 wherein the silicone emulsion has a solids content of about 70%, a pH of about 7, a viscosity of about 100 to about 500 mPa s, a vapor pressure of about 23 hPs at about 20° C. (about 68° F.), and a density of about 1 g/cm$^3$ at about 20° C. (about 68° F.).

17. The paint applicator of claim 12 wherein said fabric, fibers, or filaments are woven.

18. The paint applicator of claim 12 wherein said fabric, fibers, or filaments are knitted.

19. The paint applicator of claim 12 wherein said fabric, fibers, or filaments are comprised of nylon/polyester blends.

20. The paint applicator of claim 12 wherein said fabric, fibers, or filaments are comprised of acrylic/modacrylic blends.

21. A method of treating the paint applicator of claim 12, said method comprising the steps of:

(a) applying a silicone emulsion to a surface substrate of the applicator;

(b) drying the treated substrate surface; and (c) curing the treated substrate surface, wherein the paint applicator is a paint brush, a paint roller, or a cylindrical paint roller cover.

22. The method of claim 21, wherein the silicone emulsion comprises substances in the following percentages by weight:

(a) from about 1.0% to about 5.0% of 1,2-Ethanediamine, N-[3-(dimethoxy methylsilyl) propyl]-;

(b) from about 1.0% to about 5.0% of branched tridecanolethoxylate.

23. The method of claim 22, wherein the silicone emulsion has a solids content of about 50%, a pH of about 7, a viscosity of about 100 to about 500 mPa s, a vapor pressure of about 23 hPa at about 20° C. (about 68° F.), and a density of about 1 g/cm$^3$ at about 20° C. (about 68° F.).

24. The method of claim 21, wherein the silicone emulsion comprises substances in the following percentages by weight:

(a) from about 1.0% to about 5.0% of 1,2-Ethanediamine, N-[3-(dimethoxy methylsilyl) propyl]-;

(b) from about 1.0% to about 5.0% of branched tridecanolethoxylate; and (c) from about 0.1% to about 1.0% of acetic acid.

25. The method of claim 24, wherein the silicone emulsion has a solids content of about 70%, a pH of about 7, a viscosity of about 100 to about 500 mPa s, a vapor pressure of about 23 hPa at about 20° C. (about 68° F.), and a density of about 1 g/cm$^3$ at about 20° C. (about 68° F.).

26. The method of claim 21, wherein step (a) is performed by means of immersing or submerging the substrate surface in a bath containing a silicone emulsion.

27. The method of claim 21, wherein step (a) is performed by means of spray applying the substrate surface with a silicone emulsion.

28. The method of claim 21, wherein steps (b) and (c) are performed by means of an oven.

29. The method of claim 21, wherein steps (b) and (c) are performed by means of spin drying.

30. The method of claim 21, wherein a water based latex paint is subsequently applied to the substrate surface.

31. A device comprising a paint applicator having (1) a non-paint-carrying surface and (2) a paint-carrying surface wherein the paint-carrying surface comprises a substrate surface comprising fabric, fibers or filaments, wherein the fabric, fibers or filaments have been treated with a silicone emulsion comprising at least one nonionic macro-emulsion of a functional polysiloxane, wherein the substrate surface has improved paint-carrying capacity, release, and coverage when compared to the identical fabric, fibers, or filaments without such silicone emulsion, wherein the paint applicator is a paint brush, a paint roller, or a cylindrical paint roller cover.

32. The device of claim 1 wherein the non-paint-carrying surface is a handle.

* * * * *